US008448805B2

(12) United States Patent
Hassell et al.

(10) Patent No.: US 8,448,805 B2
(45) Date of Patent: May 28, 2013

(54) ATTACHED LID CONTAINER WITH BAG RETENTION FEATURES

(75) Inventors: Jon P. Hassell, Atlanta, GA (US); Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 198 days.

(21) Appl. No.: 12/881,393

(22) Filed: Sep. 14, 2010

(65) Prior Publication Data

US 2011/0062161 A1 Mar. 17, 2011

Related U.S. Application Data

(60) Provisional application No. 61/276,385, filed on Sep. 14, 2009.

(51) Int. Cl.

| | |
|---|---|
| ***B65D 25/14*** | (2006.01) |
| ***B65D 35/14*** | (2006.01) |
| ***B65D 90/00*** | (2006.01) |

(52) U.S. Cl.
USPC ..... 220/495.11; 220/495.08; 220/908.1

(58) Field of Classification Search
USPC ..... 220/495.08, 495.11, 826, 843, 908.1
See application file for complete search history.

(56) References Cited

U.S. PATENT DOCUMENTS

| | | | | |
|---|---|---|---|---|
| 4,437,634 | A * | 3/1984 | Hambleton | 248/97 |
| 4,664,347 | A * | 5/1987 | Brown et al. | 248/97 |
| 5,328,048 | A * | 7/1994 | Stein | 220/826 |
| 2002/0008114 | A1 * | 1/2002 | Frankenberg | 220/826 |
| 2009/0050628 | A1 * | 2/2009 | Sullivan | 220/495.1 |

* cited by examiner

*Primary Examiner* — Harry Grosso
(74) *Attorney, Agent, or Firm* — Carlson, Gaskey & Olds

(57) ABSTRACT

A container includes a base wall and a pair of opposed side walls extending upward from side edges of the base wall. A first end wall and a second end wall extend upward from end edges of the base wall. A lid is hingeably connected to each of the side walls. A first protrusion protrudes from an upper edge of the first end wall for hooking onto a bag in the container.

22 Claims, 8 Drawing Sheets

ATTACHED LID CONTAINER WITH BAG RETENTION FEATURES

This application claims priority to U.S. Provisional Application Ser. No. 61/276,385, filed Sep. 14, 2009.

BACKGROUND OF THE INVENTION

The present invention relates generally to containers and more particularly to an attached lid container with bag retention feature.

In hospital surgical rooms, medical waste containers are often attached lid containers. The containers include a base wall, a pair of opposed side walls, and a pair of opposed end walls extending up from the periphery of the base wall. Lids are attached to the upper edge of the side walls by hinges, and the opposite ends of the lids interlock with one another to selectively close the container. During use, a plastic bag is placed in the container with the upper edge of the bag folded back outwardly over the upper periphery of the open container. As a result, the plastic bag is held in place over the hinge attaching the lids to the upper edge of the side walls. If the lids are closed, the bag is knocked into the interior of the container and is not properly positioned if the lids are reopened.

SUMMARY

A container according to one embodiment includes a base wall and a pair of opposed side walls extending upward from side edges of the base wall. A first end wall and a second end wall extend upward from end edges of the base wall. A lid is hingeably connected to each of the side walls. A first protrusion protrudes from an upper edge of the first end wall for hooking onto a bag in the container.

A method for installing a bag in the container includes inserting the bag into an interior of the container and folding upper edges of the bag over upper edges of the side walls and end walls and over the lids in an open position. The lids are then moved toward a closed position, thereby causing the bag to hook around the protrusion.

DETAILED DESCRIPTION OF THE PREFERRED EMBODIMENT

Figure 1:
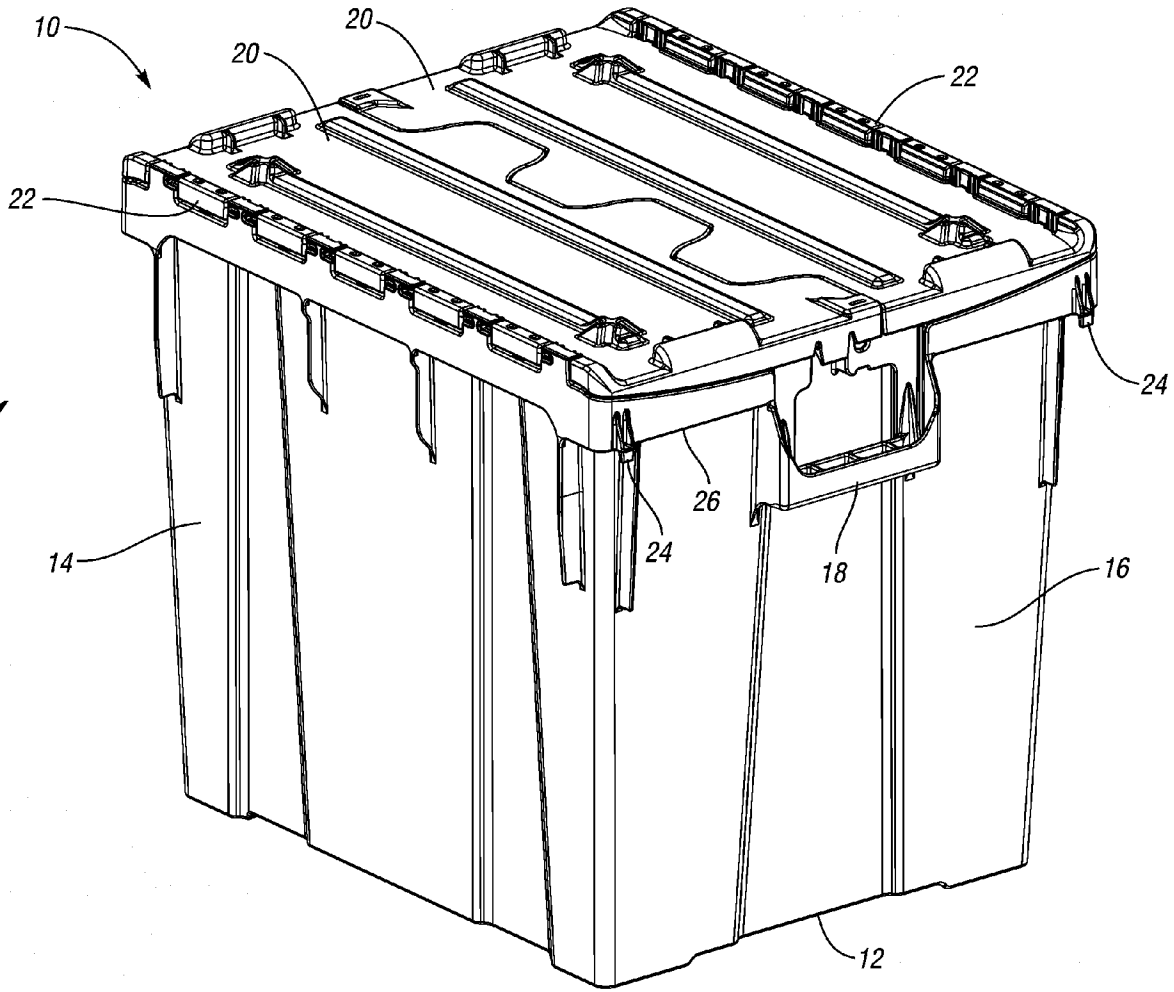
FIG. 1 is a perspective view of a container according to one embodiment of the present invention.

FIG. 1 is a perspective view of a container 10 according to one embodiment of the present invention. The container 10 includes a base wall 12, opposed side walls 14 (or long walls) and opposed end walls 16 (or short walls) extending upward from the periphery of the base wall 12. Lids 20 are hingeably connected to upper edges of the side walls 14 by hinges 22.

The lids 20 have interleaving portions at their outer ends, as is known for attached-lid containers.

The container 10 is provided with a plurality of hooks 24 (for example, two hooks 24) projecting from the upper lip 26. The hooks 24 generally each comprise a pair of ribs perpendicular to the lip 26 and extending downwardly below the lip 26, the ribs being connected to one another below the lip 26. The hooks 24 in the embodiment shown are disposed at outer edges of the end walls 16, adjacent the hinges 22. The position of the hooks is important, but could vary based upon the design of the container 10, including the lids 20 and hinges 22. Handles 18 protrude outward from each end wall 16 below the lip 26.

Figure 2:
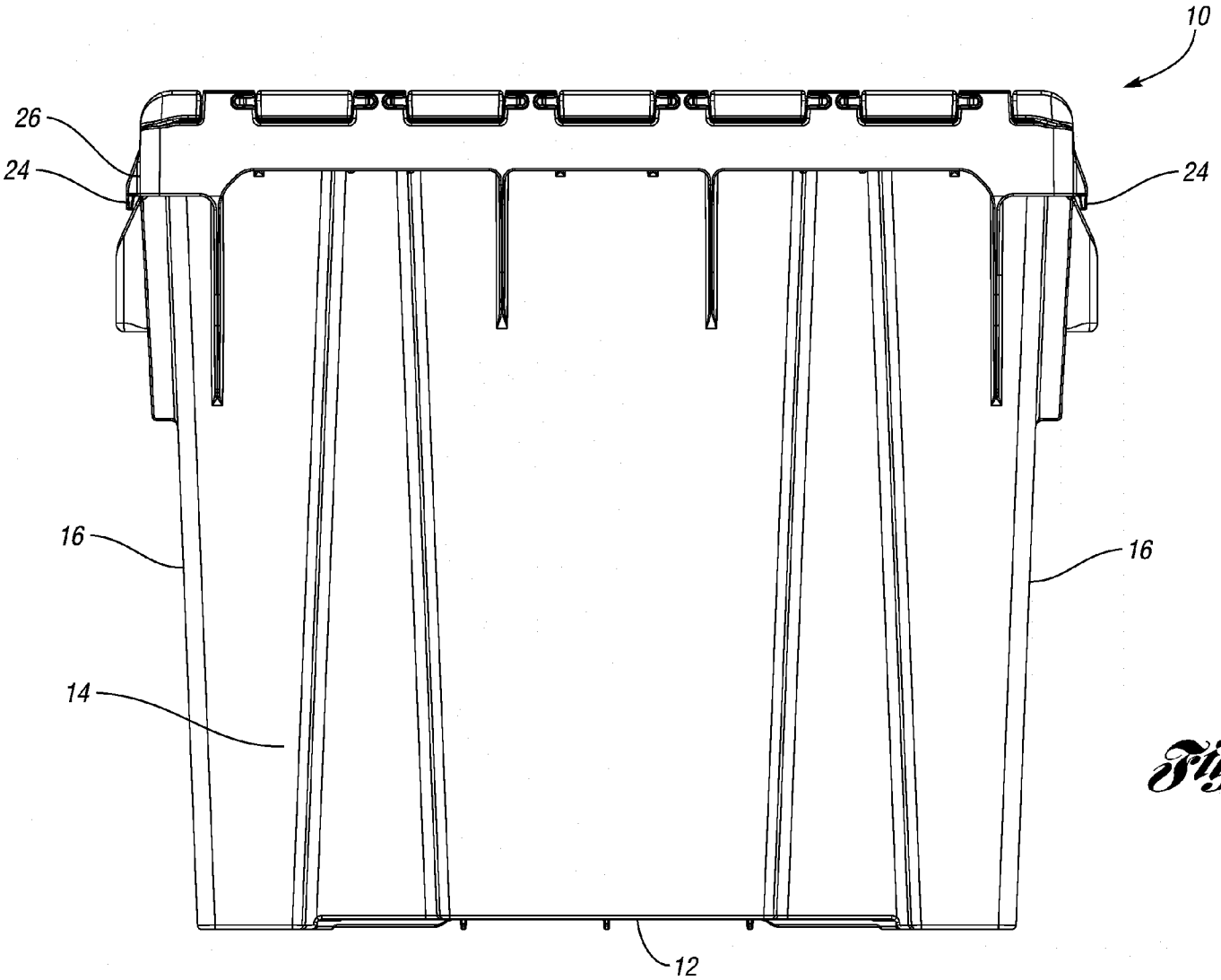
FIG. 2 is a side view of the container of FIG. 1.

As shown in FIG. 2, the hooks 24 project outwardly and downwardly from the lip 26. The hooks 24 are aligned with inner edges of hinges 22 connecting the lids 20 to the side walls 14. The protrusions 24 are aligned with the side walls 14.

Figure 3:
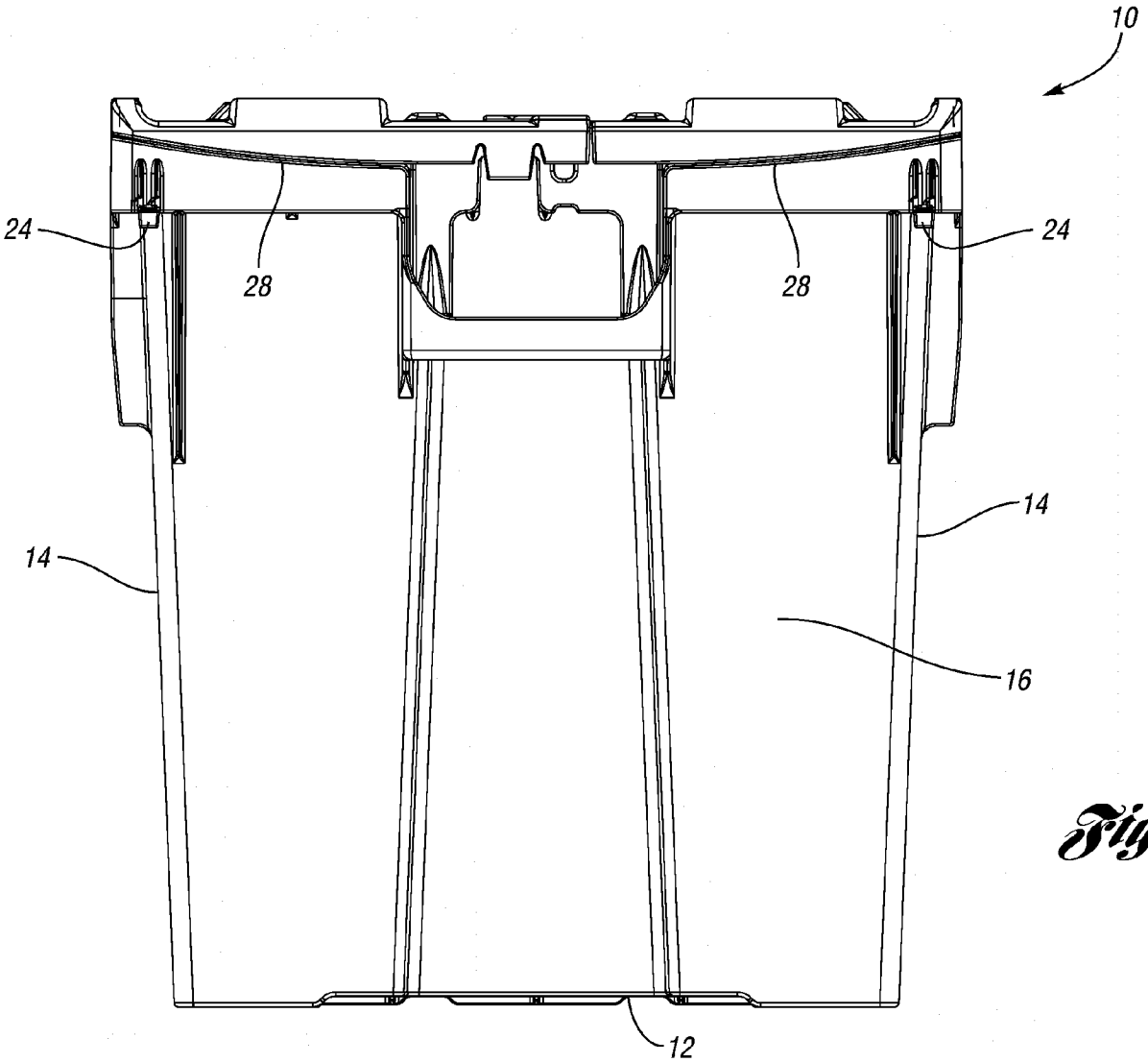
FIG. 3 is an end view of the container of FIG. 1.

FIG. 3 is an end view of the container 10. As shown in FIG. 3, the lids 20 each include angled ribs 28 on end edges of the lids 20. The angled ribs 28 taper toward the hinges 22.

Figure 4:
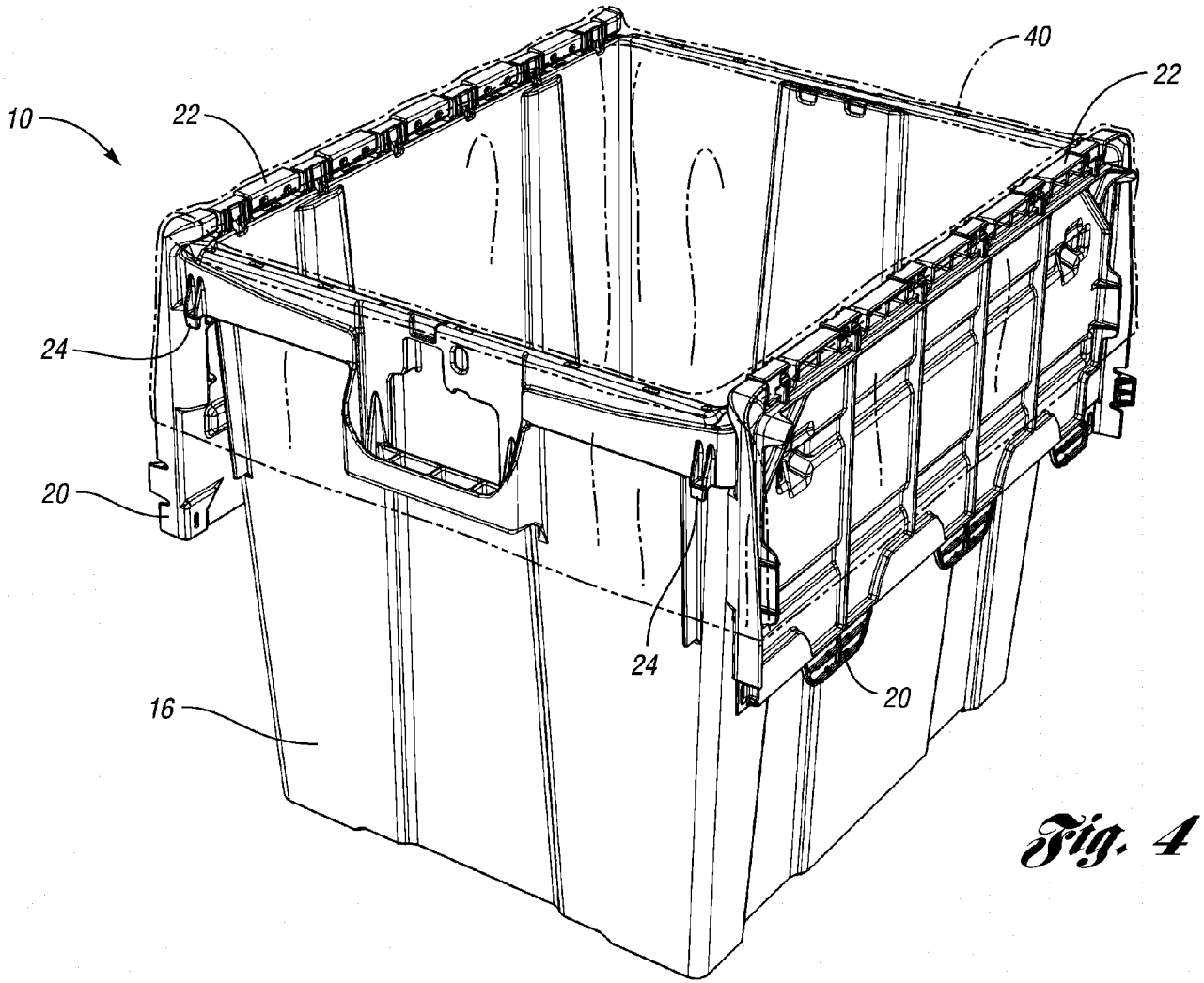
FIG. 4 shows the container of FIG. 1 with the lids opened and a plastic bag inserted therein.

In FIG. 4, the container 10 is shown with a plastic bag placed therein. The plastic bag 40 is placed in the container 10, such that the bottom of the bag 40 rests on the base wall 12, while the side walls of the bag 40 are generally aligned with the walls 14, 16 of the container 10. The upper edge of the bag 40 is folded over the upper edges of the container 10, and is folded over the lids 20, which are adjacent the side walls 14 and hanging substantially downwardly in the open position. The bag 40 extends over the edges of the end walls 16 and over the hooks 24.

Figure 5:
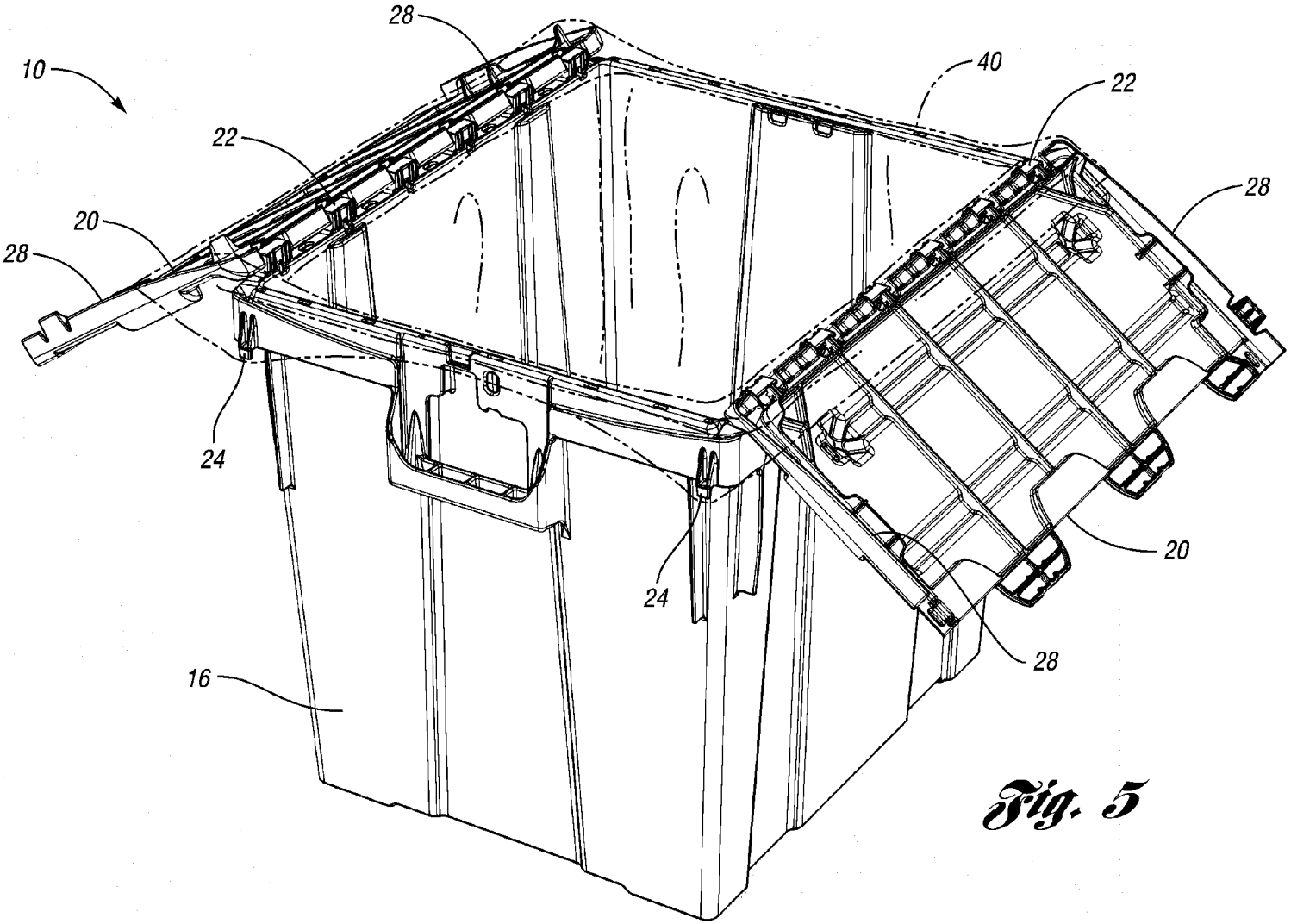
FIG. 5 shows the container and bag of FIG. 4 while the lids are being pivoted toward a closed position.

As shown in FIG. 5, without any other action required by the user, by simply pivoting the lids 20 from the open position toward the closed position, the bag 40 slides up the angled ribs 28 on end edges of the lids 20 and portions of the bag 40 are caught under the hooks 24 on both end walls 16. As the lids 20 are pivoted all the way to the closed position, the bag 40 is retained under the hooks 24 and pulled tight across the hooks 24.

Figure 6:
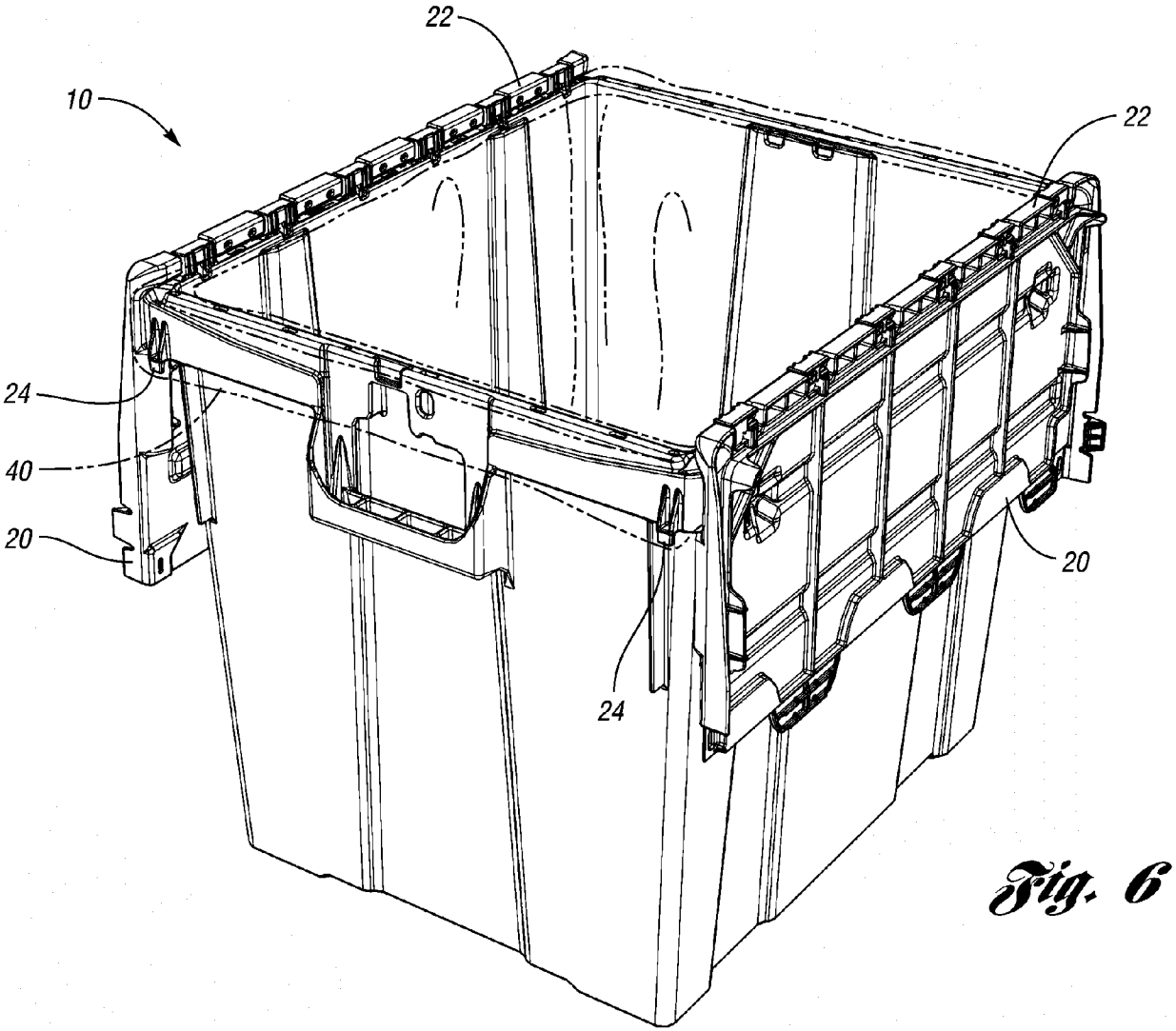
FIG. 6 shows the container and bag of FIG. 4 after the lids have been closed and opened again.
Figure 7:
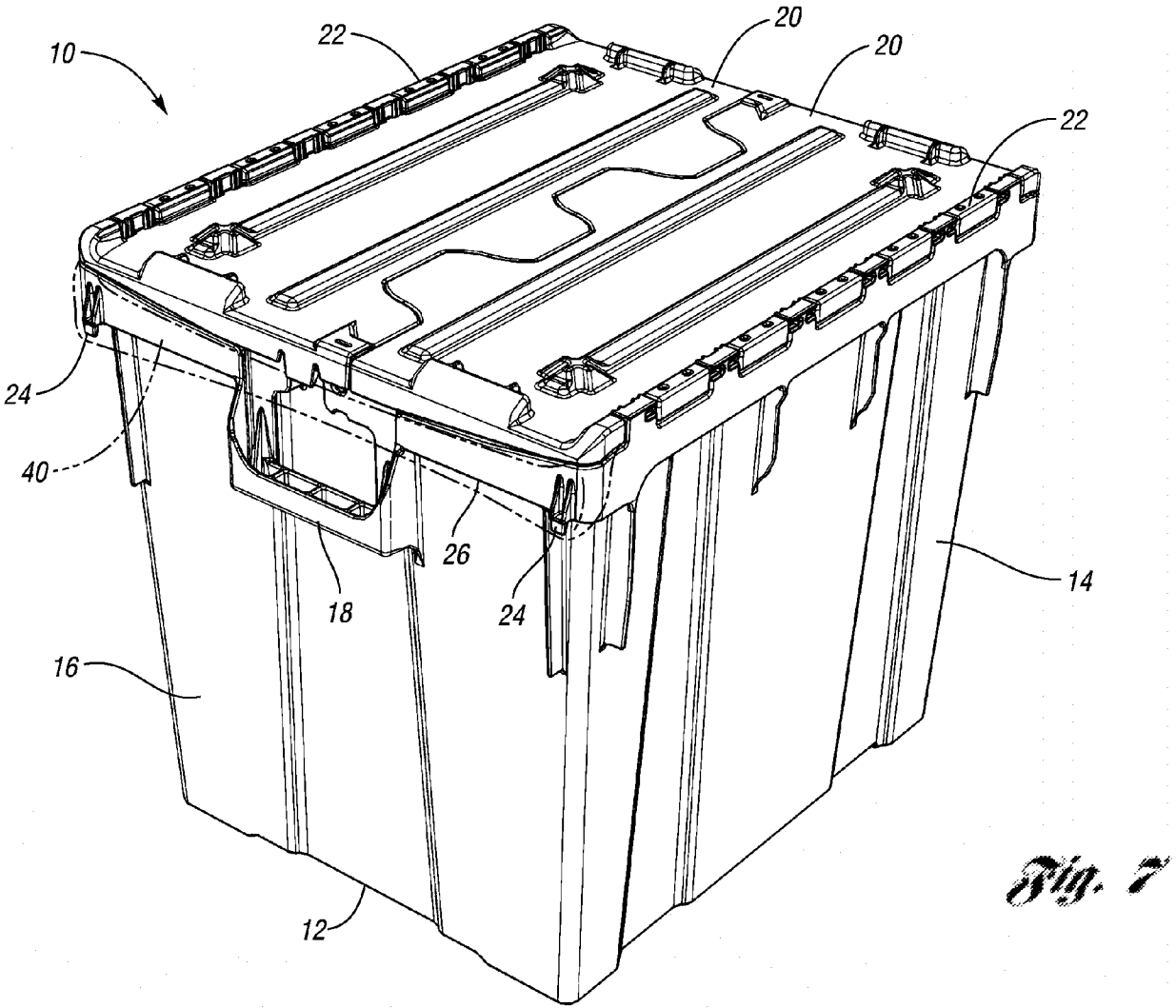
FIG. 7 shows the container and bag of FIG. 4 with the lids closed.

In FIG. 6, the bag 40 is shown in its hooked position on the hooks 24 as if the lids 20 were closed; however, the lids 20 are shown in the open position simply for visibility. As shown, the bag 40 does not fall into the container 10 when the lids 20 are closed (FIG. 7) and is properly positioned when the lids 20 are opened again (FIG. 6). The bag 40 returns to the position of FIG. 6 when the lids 20 are opened again, based upon the tension created in the bag 40 by the hooks 24. Thus, proper position of the bag 40 is maintained without any extra effort or particular actions required by the user. When the bag 40 is full, it is removed and a new bag 40 is placed in the container 40 in the same manner.

Figure 8:
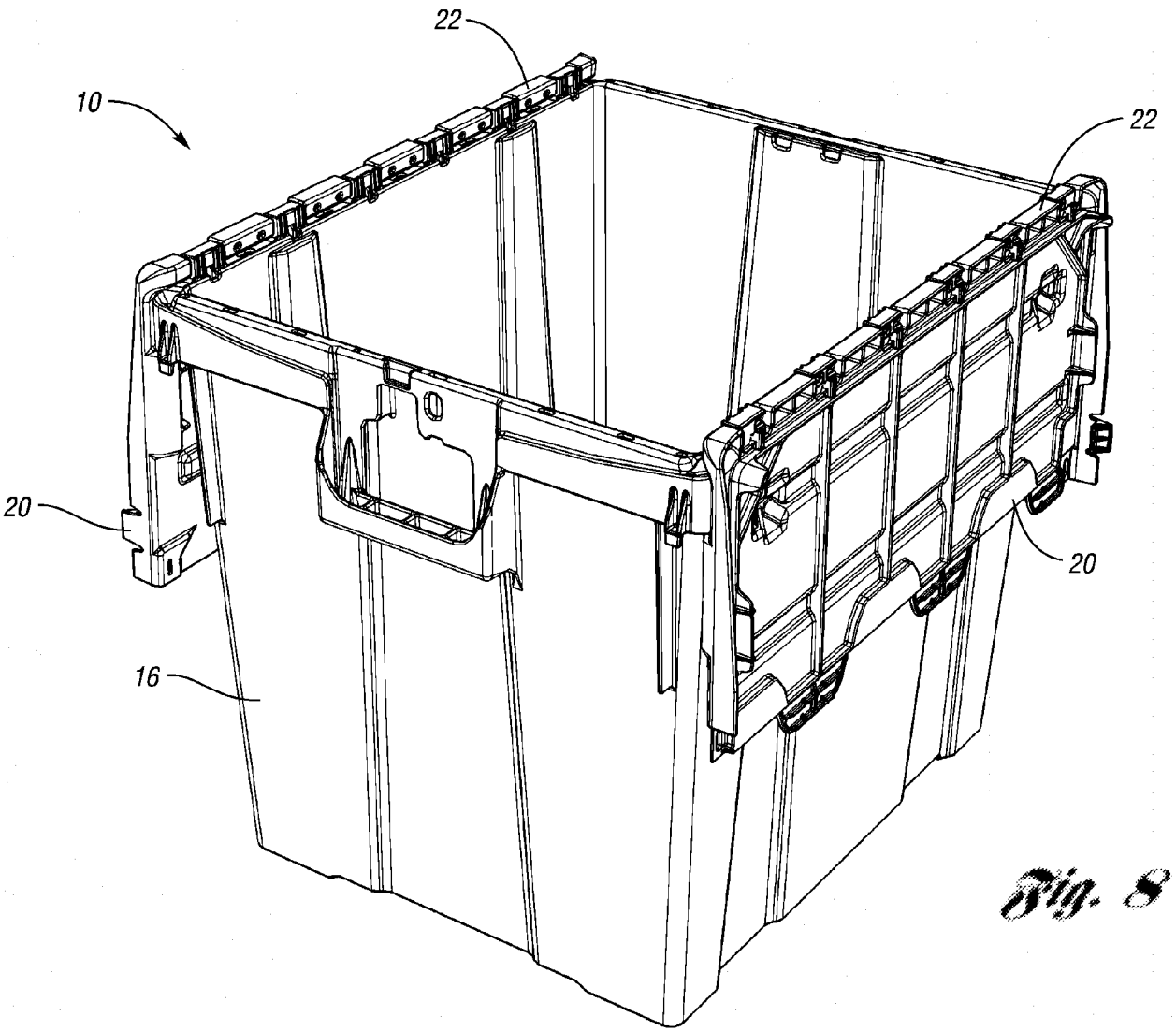
FIG. 8 shows the container of FIG. 1 with the lids opened.

FIG. 8 shows the container 10 with the lids 20 open and the bag 40 removed.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A container comprising:

a base wall;

a pair of opposed side walls extending upward from side edges of the base wall;

a first end wall and a second end wall extending upward from end edges of the base wall;

a lid hingeably connected to each of the side walls;

a first protrusion from an upper edge of the first end wall for hooking onto a bag in the container; and a handle protruding outward from the first end wall below the upper edge and below the first protrusion.

2. The container of claim 1 further including a second protrusion from an upper edge of the second end wall.

3. The container of claim 2 further including a third protrusion from the upper edge of the first end wall and a fourth protrusion from the upper edge of the second end wall, each of the protrusions from the upper edges of the end walls adjacent the side walls.

4. The container of claim 3 wherein each of the protrusions protrudes outwardly and then downwardly.

5. The container of claim 4 further including a bag inside the container, with portions of the bag hooked around each of the protrusions.

6. The container of claim 5 wherein the lids are closed, such that the bag is between the lids and the end walls.

7. The container of claim 6 further including a lip extending outwardly and downwardly from the upper edges of the end walls and upper edges of the side walls, the protrusions extending outwardly from the lip.

8. The container of claim 7 wherein the protrusions are aligned with the side walls.

9. The container of claim 7 wherein the protrusions are aligned with inner edges of hinges connecting the lids to the side walls.

10. The container of claim 9 wherein the lids each include a rib tapered downward toward a hinge connecting the lid to the side wall.

11. The container of claim 1 wherein the lids each include a rib tapered downward toward a hinge connecting the lid to the side wall.

12. A method for installing a bag in a container having a base, side walls having lids pivotably connected thereto and end walls having a protrusion therefrom, the method including the steps of:

a) inserting the bag into an interior of the container;

b) folding upper edges of the bag over upper edges of the side walls and end walls, over the protrusion and over the lids in an open position; and c) after said step b), moving the lids toward a closed position, thereby causing the bag to slide from the lids, but to remain caught under the protrusion.

13. The method of claim 12 wherein said step c) includes moving the lids to the closed position, such that the bag is between the lids and the end walls, with the bag hooked over the protrusion.

14. The method of claim 13 wherein each end wall includes a plurality of protrusions including the protrusion, the method further including the step of hooking the bag around the plurality of protrusions during said step c).

15. The method of claim 12 wherein the lids each include a rib tapered downward toward a hinge connecting the lid to the side wall.

16. A container comprising:

a base wall;

a pair of opposed side walls extending upward from side edges of the base wall;

a first end wall and a second end wall extending upward from end edges of the base wall;

a lip extending outwardly and downwardly from upper edges of the end walls and upper edges of the side walls;

a lid hingeably connected to each of the side walls; and a first protrusion outwardly from the lip of the first end wall for hooking onto a bag in the container.

17. The container of claim 16 a second protrusion outwardly and then downwardly from the lip of the first wall.

18. The container of claim 17 further including a third protrusion and a fourth protrusion from the lip of the second end wall.

19. The container of claim 16 further including a bag inside the container, with a portion of the bag hooked around the protrusion.

20. The container of claim 19 wherein the lids are closed, such that the bag is between the lids and the end walls.

21. A container and bag, the container comprising:

a base wall;

a pair of opposed side walls extending upward from side edges of the base wall;

a first end wall and a second end wall extending upward from end edges of the base wall;

a lid hingeably connected to each of the side walls;

a lip protruding outwardly and then downwardly from an upper edge of the first end wall;

a first protrusion protruding outwardly and then downwardly from the lip for hooking onto a bag in the container; and the bag inside the container, with a portion of the bag hooked around the protrusion.

22. The container and bag of claim 21 wherein the lids are closed, such that the bag is between the lids and the end walls while hooked around the protrusion.

* * * * *